US010096889B2

(12) United States Patent
Yang

(10) Patent No.: US 10,096,889 B2
(45) Date of Patent: Oct. 9, 2018

(54) MOBILE DEVICE

(71) Applicant: Acer Incorporated, New Taipei (TW)

(72) Inventor: Chung-Wen Yang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 40 days.

(21) Appl. No.: 15/331,087

(22) Filed: Oct. 21, 2016

(65) Prior Publication Data

US 2018/0062243 A1 Mar. 1, 2018

(30) Foreign Application Priority Data

Aug. 25, 2016 (TW) ..... 105127217 A

(51) Int. Cl.

| | |
|---|---|
| ***H01Q 1/24*** | (2006.01) |
| ***H01Q 1/48*** | (2006.01) |
| ***H01Q 1/36*** | (2006.01) |
| ***H01Q 1/22*** | (2006.01) |
| ***H01Q 5/385*** | (2015.01) |

(52) U.S. Cl.

CPC ..... *H01Q 1/243* (2013.01); *H01Q 1/2291* (2013.01); *H01Q 1/36* (2013.01); *H01Q 1/48* (2013.01); *H01Q 5/385* (2015.01)

(58) Field of Classification Search

CPC ..... H01Q 1/243; H01Q 5/385

See application file for complete search history.

(56) References Cited

U.S. PATENT DOCUMENTS

| | | | | |
|---|---|---|---|---|
| 8,436,774 | B2 * | 5/2013 | Wong | H01Q 1/243 343/700 MS |
| 2007/0285321 | A1 | 12/2007 | Chung et al. | |
| 2014/0256388 | A1 | 9/2014 | Lin et al. | |
| 2015/0070239 | A1 * | 3/2015 | Hung | H01Q 1/48 343/848 |
| 2015/0123871 | A1 * | 5/2015 | Chang | H01Q 1/243 343/872 |
| 2015/0255854 | A1 | 9/2015 | Lin et al. | |

(Continued)

FOREIGN PATENT DOCUMENTS

| | | | |
|---|---|---|---|
| TW | 200729612 | A | 8/2007 |
| TW | 201324942 | A1 | 6/2013 |
| TW | 201401646 | A | 1/2014 |

OTHER PUBLICATIONS

Chinese language office action dated Nov. 20, 2017, issued in application No. TW 105127217.

(Continued)

*Primary Examiner* — Jessica Han
*Assistant Examiner* — Amal Patel
(74) *Attorney, Agent, or Firm* — McClure, Qualey & Rodack, LLP

(57) ABSTRACT

A mobile device includes an antenna structure. The antenna structure includes a main radiation element, a first parasitic element, and a second parasitic element. The main radiation element has a feeding point. The first parasitic element has a first grounding point. The first parasitic element is adjacent to the main radiation element, and the first grounding point is adjacent to the feeding point. The second parasitic element has a second grounding point. The second parasitic element is adjacent to an end of the main radiation element.

8 Claims, 7 Drawing Sheets

(56) References Cited

U.S. PATENT DOCUMENTS

| | | | | |
|---|---|---|---|---|
| 2015/0333390 | A1* | 11/2015 | Peng | H01Q 1/243 343/702 |
| 2016/0028150 | A1 | 1/2016 | Chou et al. | |
| 2016/0134018 | A1 | 5/2016 | Wu | |

OTHER PUBLICATIONS

European Search Report dated Nov. 20, 2017, issued in application No. 16193505.1-1927.

* cited by examiner

MOBILE DEVICE

CROSS REFERENCE TO RELATED APPLICATIONS

This Application claims priority of Taiwan Patent Application No. 105127217 filed on Aug. 25, 2016, the entirety of which is incorporated by reference herein.

BACKGROUND OF THE INVENTION

Field of the Invention

The disclosure generally relates to a mobile device, and more particularly, to a mobile device and an antenna structure therein.

Description of the Related Art

With advancements in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, the newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In a preferred embodiment, the invention is directed to a mobile device including an antenna structure. The antenna structure includes a main radiation element, a first parasitic element, and a second parasitic element. The main radiation element has a feeding point. The first parasitic element has a first grounding point. The first parasitic element is adjacent to the main radiation element, and the first grounding point is adjacent to the feeding point. The second parasitic element has a second grounding point. The second parasitic element is adjacent to a first end of the main radiation element.

In some embodiments, the feeding point is positioned at a second end of the main radiation element.

In some embodiments, each of the main radiation element and the first parasitic element substantially has a straight-line shape. The main radiation element and the first parasitic element are substantially parallel to each other.

In some embodiments, the second parasitic element substantially has an N-shape.

In some embodiments, a first coupling gap is formed between the main radiation element and the first parasitic element. A width of the first coupling gap is from 0.3 mm to 2 mm.

In some embodiments, a second coupling gap and a third coupling gap are formed between the first end of the main radiation element and the second parasitic element. A width of each of the second coupling gap and the third coupling gap is from 0.3 mm to 2 mm.

In some embodiments, the antenna structure operates in a low-frequency band and a high-frequency band. The low-frequency band is from 2400 MHz to 2500 MHz. The high-frequency band is from 5150 MHz to 5850 MHz.

In some embodiments, the length of the main radiation element is about 0.25 wavelength of the low-frequency band. The length of the first parasitic element is about 0.25 wavelength of the low-frequency band. The length of the second parasitic element is about 0.25 wavelength of the high-frequency band.

In some embodiments, the first parasitic element lies on a first plane. The main radiation element and the second parasitic element lie on a second plane. The first plane and the second plane are substantially perpendicular to each other.

In some embodiments, the mobile device further includes a dielectric substrate and a metal back cover. The main radiation element and the second parasitic element are disposed on the dielectric substrate. The metal back cover includes a bottom plane and a side wall. The side wall and the bottom plane are substantially perpendicular to each other. The side wall has an opening. The dielectric substrate and the first parasitic element are adjacent to the side wall. The antenna structure has a vertical projection on the side wall, and the vertical projection is at least partially inside the opening.

In some embodiments, the antenna structure further includes an auxiliary radiation element. The auxiliary radiation element substantially has a straight-line shape. The first end of the auxiliary radiation element is coupled to the feeding point. The second end of the auxiliary radiation element is open.

In some embodiments, the antenna structure further includes a third parasitic element. The third parasitic element substantially has an L-shape. The first end of the third parasitic element is a third grounding point. The second end of the third parasitic element is open and adjacent to a median portion of the main radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
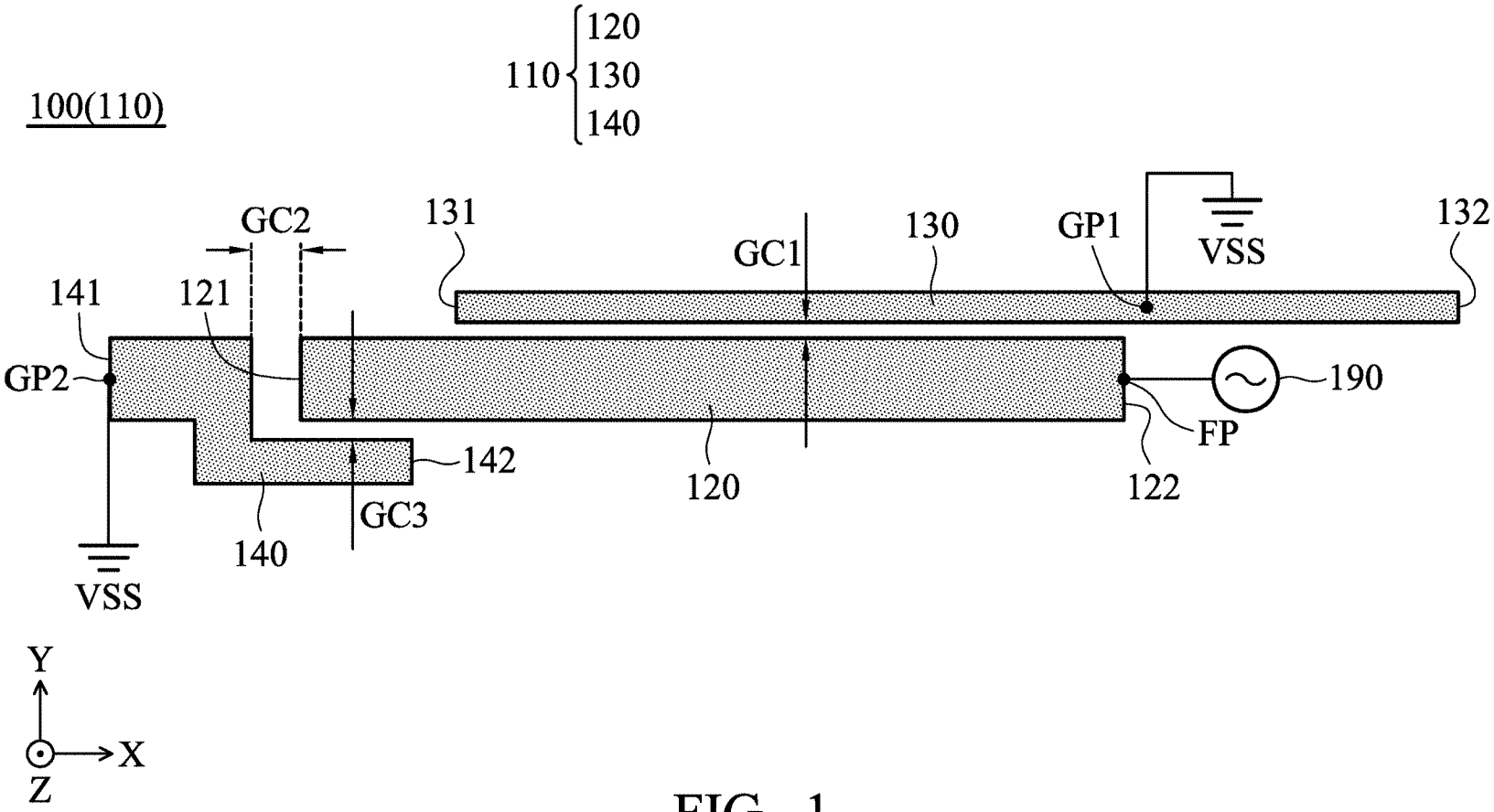
FIG. 1 is a top view of a mobile device according to an embodiment of the invention.

FIG. 1 is a top view of a mobile device 100 according to an embodiment of the invention. The mobile device 100 may be a smartphone, a tablet computer, or a notebook computer. As shown in FIG. 1, the mobile device 100 at least includes an antenna structure 110. It should be understood that the mobile device 100 may further include other components, such as a touch-control module, a power supply module, a display device, a keyboard, and/or a housing, although they are not displayed in FIG. 1. The antenna structure 110 includes a main radiation element 120, a first parasitic element 130, and a second parasitic element 140. The main radiation element 120, the first parasitic element 130, and the second parasitic element 140 are made of conductive materials, such as copper, silver, aluminum, iron, or their alloys. The main radiation element 120 may substantially have a straight-line shape. The main radiation element 120 has a first end 121 and a second end 122. The first end 121 of the main radiation element 120 is open. The second end 122 of the main radiation element 120 is a feeding point FP. The feeding point FP may be coupled to a signal source 190, such as an RF (Radio Frequency) module, for exciting the antenna structure 110. The first parasitic element 130 may substantially have a straight-line shape. The first parasitic element 130 and the main radiation element 120 may be substantially parallel to each other. The first parasitic element 130 has a first end 131 and a second end 132. The first end 131 and the second end 132 of the first parasitic element 130 are both open. However, the invention is not limited thereto. In another embodiment, the second end 132 of the first parasitic element 130 is not open, and is coupled to a metal back cover. A first grounding point GP1 on the first parasitic element 130 is positioned between the first end 131 and the second end 132 of the first parasitic element 130. The first grounding point GP1 may be coupled to a ground voltage VSS. The first parasitic element 130 is adjacent to the main radiation element 120. The first grounding point GP1 is adjacent to the feeding point FP. For example, the distance between the first grounding point GP1 and the feeding point FP may be shorter than 2 mm. The second parasitic element 140 may substantially have an N-shape. The second parasitic element 140 has a first end 141 and a second end 142. The first end 141 of the second parasitic element 140 is a second grounding point GP2. The second end 142 of the second parasitic element 140 is open. The second grounding point GP2 may be coupled to the ground voltage VSS. A bend portion of the second parasitic element 140 is adjacent to the first end 121 of the main radiation element 120. Specifically, a first coupling gap GC1 is formed between the main radiation element 120 and the first parasitic element 130, and a second coupling gap GC2 and a third coupling gap GC3 are formed between the first end 121 of the main radiation element 120 and the second parasitic element 140.

Figure 2:
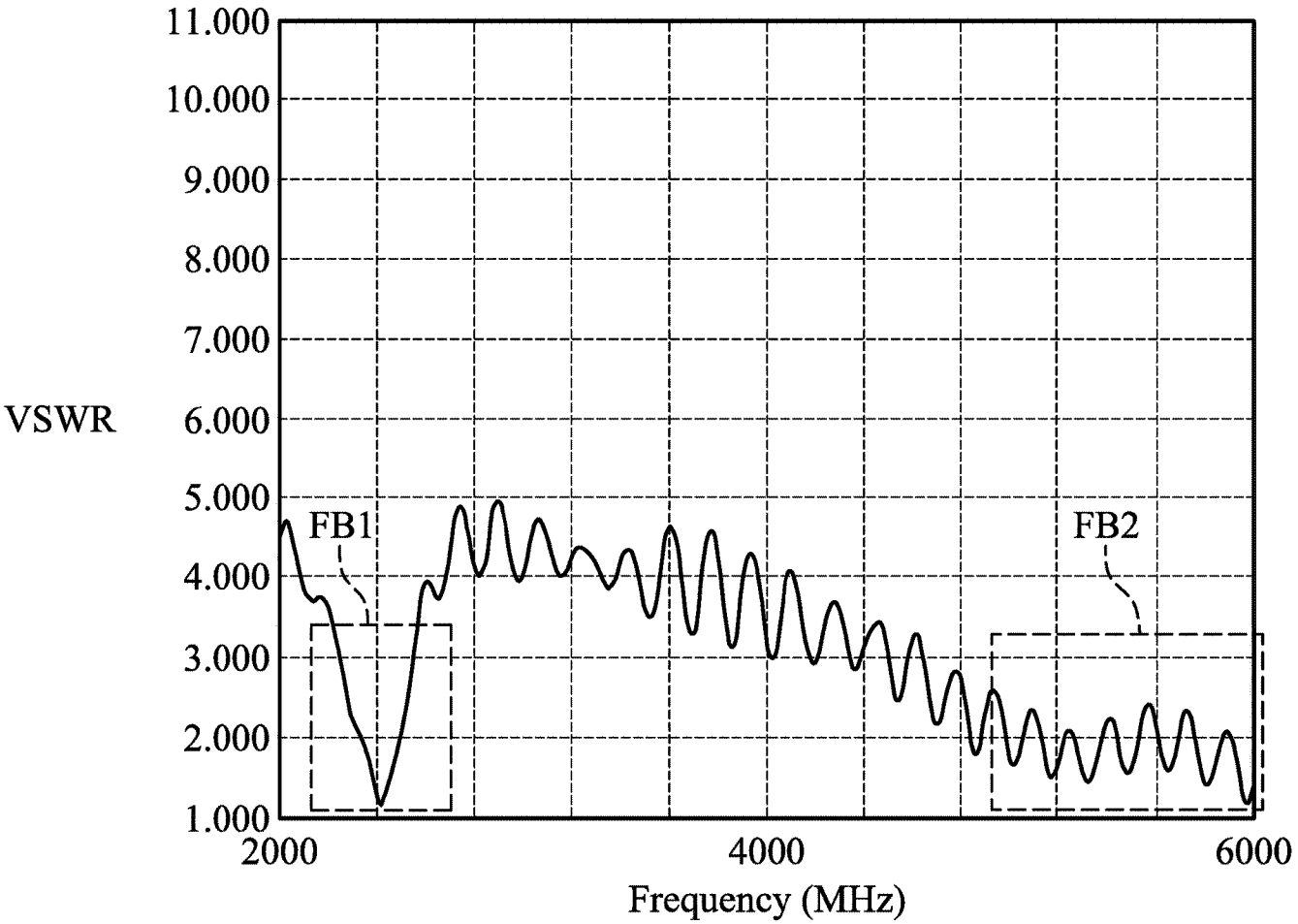
FIG. 2 is a diagram of VSWR (Voltage Standing Wave Ratio) of an antenna structure of a mobile device according to an embodiment of the invention.

FIG. 2 is a diagram of VSWR (Voltage Standing Wave Ratio) of the antenna structure 110 of the mobile device 100 according to an embodiment of the invention. The horizontal axis represents the operation frequency (MHz), and the vertical axis represents the VSWR. As shown in FIG. 2, the antenna structure 110 can at least cover a low-frequency band FB1 and a high-frequency band FB2. The low-frequency band FB1 is from 2400 MHz to 2500 MHz. The high-frequency band FB2 is from 5150 MHz to 5850 MHz. Therefore, the antenna structure 110 can at least support the dual-band operation of WLAN (Wireless Local Area Networks) 2.4 GHz/5GHz. According to the practical measurement, the antenna efficiency of the antenna structure 110 is about 48% in the low-frequency band FB1, and is about 28% in the high-frequency band FB2. This meets the practical requirements of application in a general mobile communication device.

With regard to the antenna theory, the main radiation element 120 is directly fed by the signal source 190, and the first parasitic element 130 and the second parasitic element 140 are excited by the main radiation element 120 by coupling. Specifically, the main radiation element 120 is excited to generate a fundamental resonant mode for forming the low-frequency band FB1. The first parasitic element 130 is arranged for increasing the bandwidth of the low-frequency band FB1 and adjusting the impedance matching of the low-frequency band FB1. The second parasitic element 140 is excited to generate a fundamental resonant mode for forming the high-frequency band FB2. The main radiation element 120 is further excited to generate a higher-order resonant mode for increasing the bandwidth of the high-frequency band FB2.

In some embodiments, the element size of the mobile device 100 is as follows. The length of the main radiation element 120 is about 0.25 wavelength ($\lambda/4$) of the low-frequency band FB1. The length of the first parasitic element 130 is about 0.25 wavelength ($\lambda/4$) of the low-frequency band FB1. The length of the second parasitic element 140 is about 0.25 wavelength ($\lambda/4$) of the high-frequency band FB2. The width of the first coupling gap GC1 is from 0.3 mm to 2 mm, such as 0.5 mm. The width of the second coupling gap GC2 is from 0.3 mm to 2 mm, such as 0.8 mm. The width of the third coupling gap GC3 is from 0.3 mm to 2 mm, such as 0.5 mm. As a matter of fact, the length of the first parasitic element 130 is slightly shorter than the length of the main radiation element 120 due to the mutual coupling effect therebetween.

Figure 3:
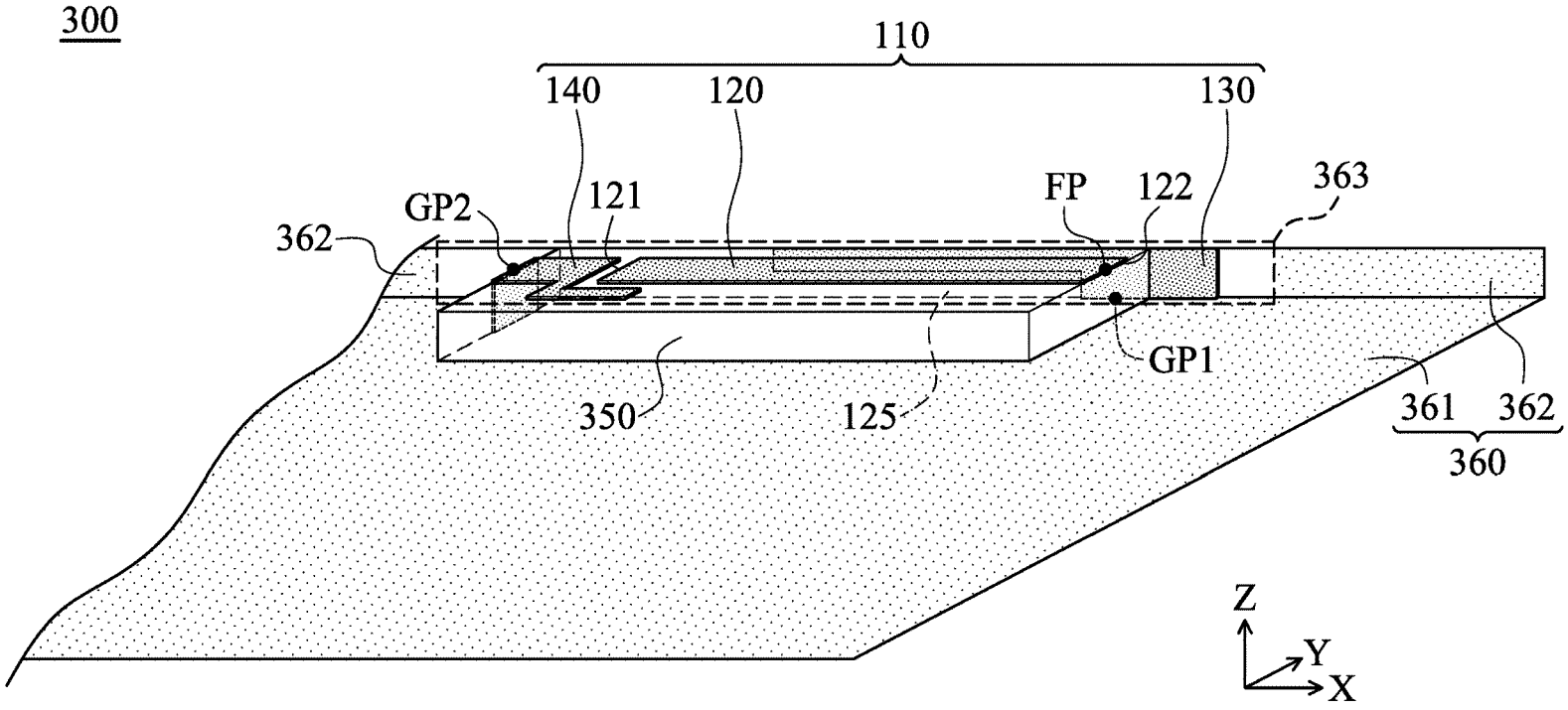
FIG. 3 is a perspective view of a mobile device according to an embodiment of the invention.

FIG. 3 is a perspective view of a mobile device 300 according to an embodiment of the invention. FIG. 3 is similar to FIG. 1. The difference between the two embodiments is that the mobile device 300 further includes a dielectric substrate 350 and a metal back cover 360, in addition to the antenna structure 110. The dielectric substrate 350 may be a thin and flat FR4 (Flame Retardant 4) substrate. The main radiation element 120 and the second parasitic element 140 are disposed on the dielectric substrate 350. The metal back cover 360 includes a bottom plane 361 and a side wall 362. The side wall 362 and the bottom plane 361 are substantially perpendicular to each other. The first parasitic element 130 and the dielectric substrate 350 are adjacent to the side wall 362 of the metal back cover 360. In alternative embodiments, the first parasitic element 130 lies directly on the side wall 362 of the metal back cover 360.

Specifically, the first parasitic element 130 lies on a first plane (e.g., the first plane may be parallel to XZ plane), and the main radiation element 120 and the second parasitic element 140 lie on a second plane (e.g., the second plane may be parallel to XY plane). The first plane and the second plane may be substantially perpendicular to each other. The metal back cover 360 provides the ground voltage VSS. The first grounding point GP1 of the first parasitic element 130 may be coupled to the bottom plane 361 of the metal back cover 360. A slit 125 may be formed between the first parasitic element 130 and the bottom plane 361 of the metal back cover 360, so that at least one portion of the first parasitic element 130 is not connected to the bottom plane 361 of the metal back cover 360. The second grounding point GP2 of the second parasitic element 140 may be coupled through a connection element or a via element to the bottom plane 361 of the metal back cover 360. The side wall 362 of the metal back cover 360 has an opening 363, which may substantially have a long and narrow rectangular shape. The antenna structure 110 (including the main radiation element 120, the first parasitic element 130, and the second parasitic element 140) has a vertical projection on the side wall 362 of the metal back cover 360, and the aforementioned vertical projection is at least partially inside the opening 363 of the side wall 362. For example, the position of the aforementioned vertical projection of the antenna structure 110 may be completely inside the opening 363, or alternatively, the position of the aforementioned vertical projection of the antenna structure 110 may extend beyond the first parasitic element 130 (i.e., the vertical projection of the first parasitic element 130 partially overlaps with the opening 363). With such a design, the electromagnetic waves of the antenna structure 110 may be transmitted through the opening 363 of the side wall 362.

Figure 4A:
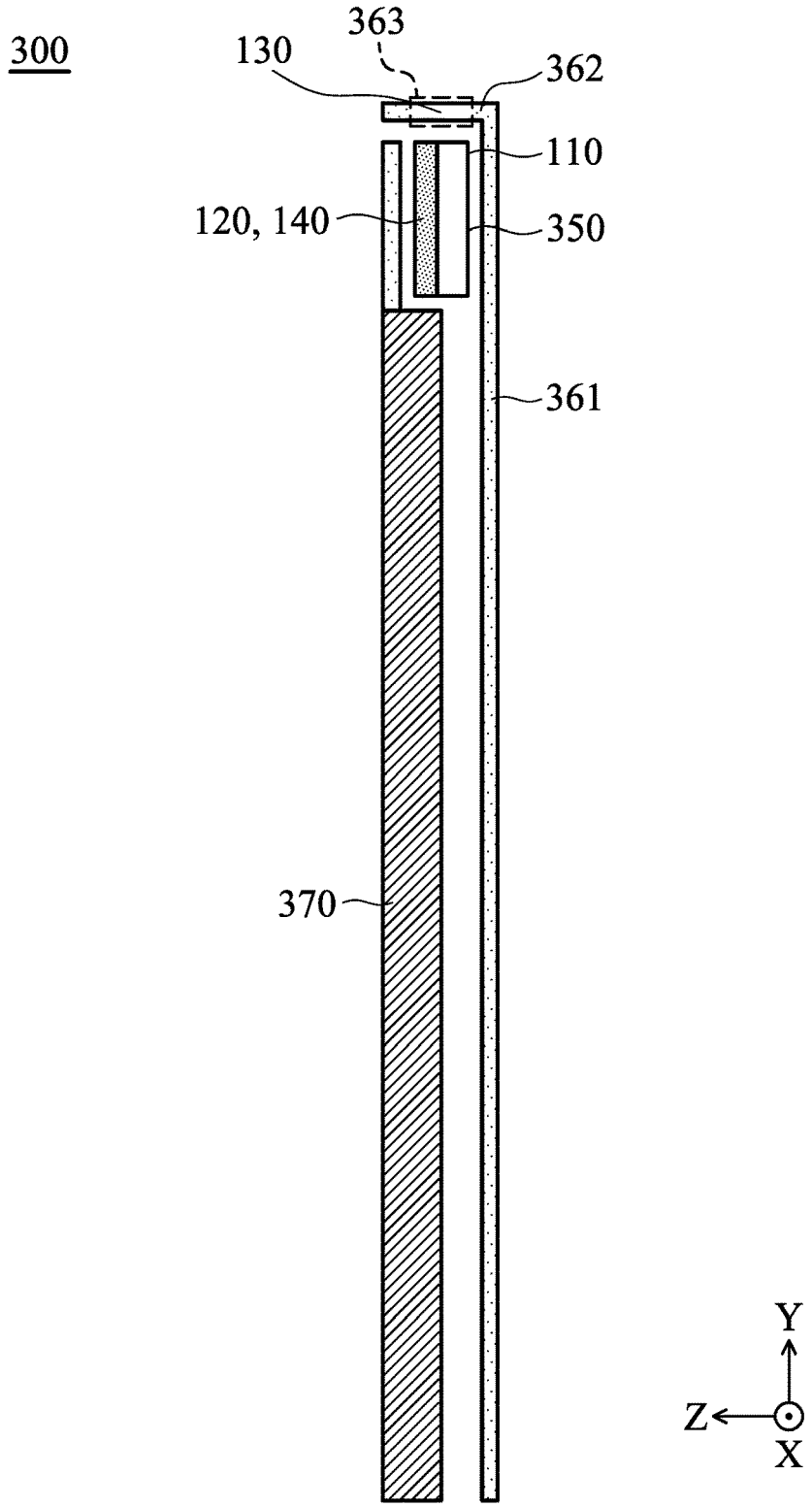
FIG. 4A is a sectional view of a mobile device according to an embodiment of the invention.
Figure 4B:
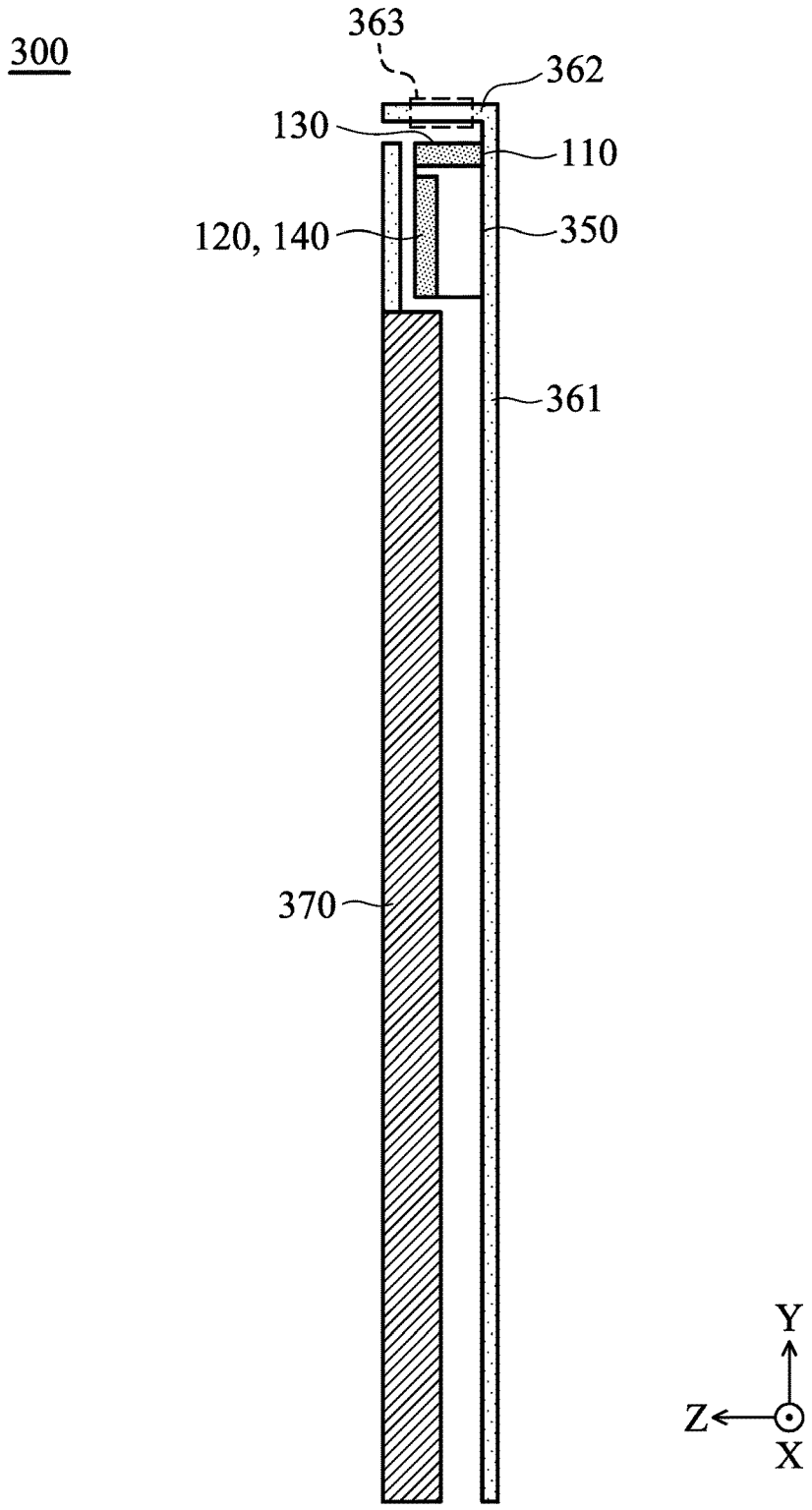
FIG. 4B is a sectional view of a mobile device according to another embodiment of the invention.

FIG. 4A is a sectional view of the mobile device 300 according to an embodiment of the invention (FIG. 4B is a sectional view of the mobile device 300 according to another embodiment of the invention). In the embodiment of FIG. 4A, the mobile device 300 further includes a display device 370. For example, if the mobile device 300 is a notebook computer, the aforementioned metal back cover 360, the aforementioned dielectric substrate 350, the aforementioned display device 370, and the aforementioned antenna structure 110 may be portions of an upper cover of the notebook computer. The display device 370 may be substantially parallel to the bottom plane 361 of the metal back cover 360. The large-area bottom plane 361 of the metal back cover 360 can maintain a complete metal-plane appearance without any antenna window because the opening 363 is formed on the side wall 362 of the metal back cover 360. Furthermore, since the opening 363 of the side wall 362 may be used for transmission of electromagnetic waves, the existence of the metal back cover 360 does not negatively affect the radiation performance of the antenna structure 110 so much. Such a design has the advantages of improving the device's appearance and maintaining the antenna's radiation performance, and it is suitable for application in a variety of small-size mobile communication devices.

Figure 5:
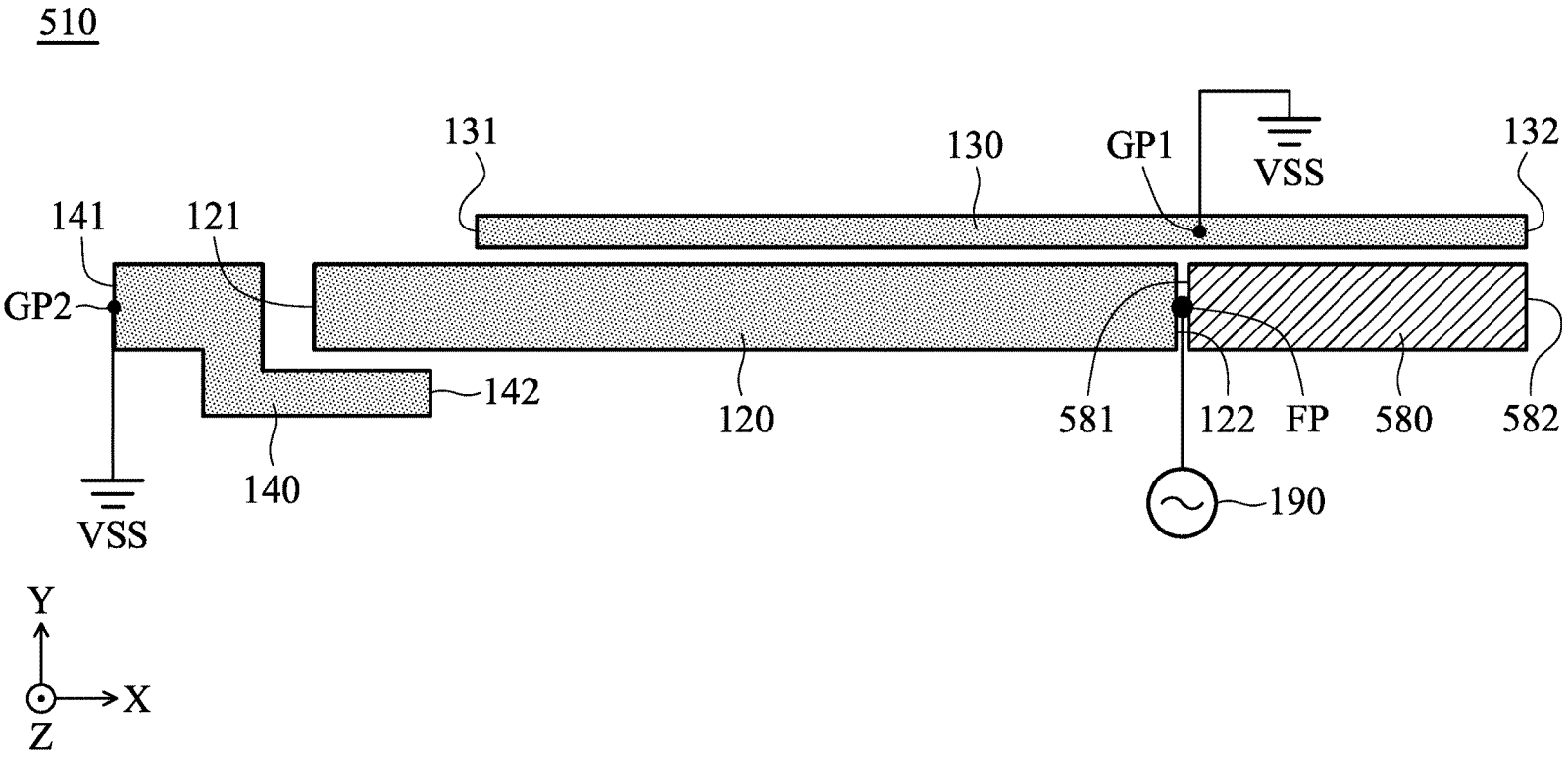
FIG. 5 is a top view of an antenna structure according to another embodiment of the invention.

FIG. 5 is a top view of an antenna structure 510 according to another embodiment of the invention. The antenna structure 510 may be applied to the mobile device 300 of the embodiments of FIG. 3 and FIG. 4. FIG. 5 is similar to FIG. 1. The difference between the two embodiments is that the antenna structure 510 further includes an auxiliary radiation element 580, which is made of conductive materials, such as copper, silver, aluminum, iron, or their alloys. The auxiliary radiation element 580 may substantially have a straight-line shape. The auxiliary radiation element 580 has a first end 581 and a second end 582. The first end 581 of the auxiliary radiation element 580 is coupled to the feeding point FP. The second end 582 of the auxiliary radiation element 580 is open. A combination of the main radiation element 120 and the auxiliary radiation element 580 forms a longer straight-line shape. The auxiliary radiation element 580 is arranged for increasing the bandwidth of the high-frequency band FB2. Other features of the antenna structure 510 of FIG. 5 are similar to those of the antenna structure 110 of FIG. 1. Accordingly, the two embodiments can achieve similar levels of performance.

Figure 6:
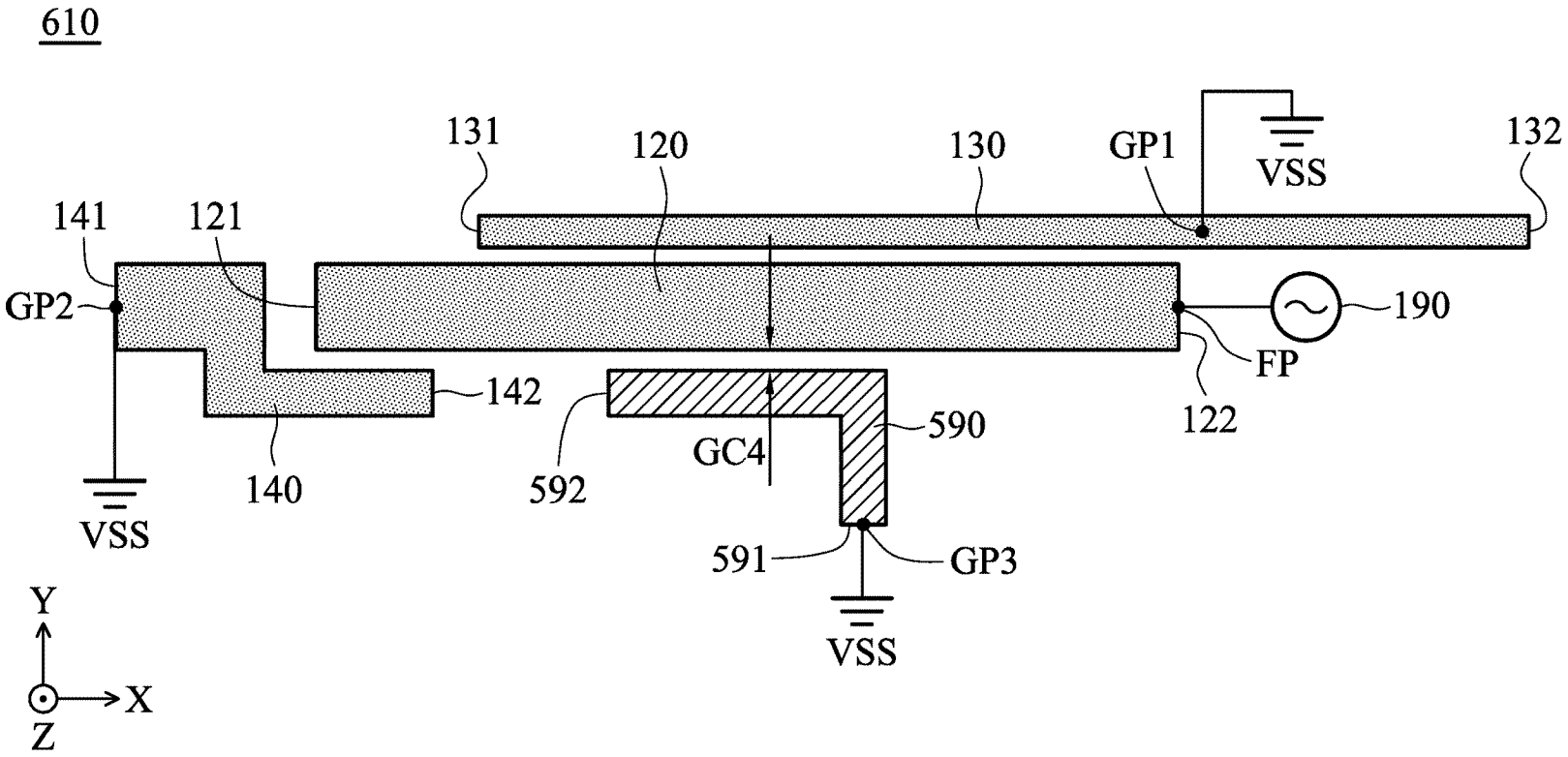
FIG. 6 is a top view of an antenna structure according to another embodiment of the invention.

FIG. 6 is a top view of an antenna structure 610 according to another embodiment of the invention. The antenna structure 610 may be applied to the mobile device 300 of the embodiments of FIG. 3 and FIG. 4. FIG. 6 is similar to FIG. 1. The difference between the two embodiments is that the antenna structure 610 further includes a third parasitic element 590, which is made of conductive materials, such as copper, silver, aluminum, iron, or their alloys. The third parasitic element 590 may substantially have an L-shape. The third parasitic element 590 has a first end 591 and a second end 592. The first end 591 of the third parasitic element 590 is a third grounding point GP3. The second end 592 of the third parasitic element 590 is open and adjacent to a median portion of the main radiation element 120. To improve the impedance matching, according to the measurement result, the distance between the third grounding point GP3 and the feeding point FP is from 5 mm to 10 mm. A fourth coupling gap GC4 is formed between the third parasitic element 590 and the median portion of the main radiation element 120, so that the third parasitic element 590 is excited by the main radiation element 120 by coupling. The third parasitic element 590 is arranged for increasing the bandwidth of the high-frequency band FB2. The length of the third parasitic element 590 is about 0.25 wavelength ($\lambda/4$) of the high-frequency band FB2. Other features of the antenna structure 610 of FIG. 6 are similar to those of the antenna structure 110 of FIG. 1. Accordingly, the two embodiments can achieve similar levels of performance.

The invention proposes a novel antenna structure, which can be used independently for covering dual-wideband operation, or applied in a mobile device with a metal back cover. When the antenna structure is applied in the mobile device, it can prevent the metal back cover from negatively affecting the communication quality of the mobile device. Furthermore, the proposed design can improve the appearance of the mobile device, without opening any antenna windows.

Note that the above element sizes, element shapes, and frequency ranges are not limitations of the invention. An antenna designer can fine-tune these settings or values according to different requirements. It should be understood that the mobile device and the antenna structure of the invention are not limited to the configurations of FIGS. 1-6. The invention may include any one or more features of any one or more embodiments of FIGS. 1-6. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

an antenna structure, comprising:

a main radiation element, having a feeding point;

a first parasitic element, having a first grounding point, wherein the first parasitic element is adjacent to the main radiation element, and wherein the first grounding point is adjacent to the feeding point; and a second parasitic element, having a second grounding point, wherein the second parasitic element is adjacent to a first end of the main radiation element;

wherein the antenna structure operates in a low-frequency band and a high-frequency band, wherein the low-frequency band is from 2400 MHz to 2500 MHz, and wherein the high-frequency band is from 5150 MHz to 5850 MHz;

wherein the antenna structure further comprises a third parasitic element, wherein the third parasitic element substantially has an L-shape, wherein a first end of the third parasitic element is a third grounding point, and wherein a second end of the third parasitic element is open and adjacent to a median portion of the main radiation element;

wherein a length of the third parasitic element is about 0.25 wavelength of the high-frequency band;

wherein the second parasitic element substantially had an N-shape; and wherein the antenna structure further comprises as auxiliary radiation element, wherein the auxiliary radiation element substantially has a straight-line shape, wherein a first end of the auxiliary radiation element is coupled to the feeding point, and wherein a second end of the auxiliary element is open.

2. The mobile device as claimed in claim 1, wherein the feeding point is positioned at a second end of the main radiation element.

3. The mobile device as claimed in claim 1, wherein each of the main radiation element and the first parasitic element substantially has a straight-line shape, and wherein the main radiation element and the first parasitic element are substantially parallel to each other.

4. The mobile device as claimed in claim 1, wherein a first coupling gap is formed between the main radiation element and the first parasitic element, and wherein a width of the first coupling gap is from 0.3 mm to 2 mm.

5. The mobile device as claimed in claim 1, wherein a second coupling gap and a third coupling gap are formed between the first end of the main radiation element and the second parasitic element, and wherein a width of each of the second coupling gap and the third coupling gap is from 0.3 mm to 2 mm.

6. The mobile device as claimed in claim 1, wherein a length of the main radiation element is about 0.25 wavelength of the low-frequency band, wherein a length of the first parasitic element is about 0.25 wavelength of the low-frequency band, and wherein a length of the second parasitic element is about 0.25 wavelength of the high-frequency band.

7. The mobile device as claimed in claim 1, wherein the first parasitic element lies on a first plane, wherein the main radiation element and the second parasitic element lie on a second plane, and wherein the first plane and the second plane are substantially perpendicular to each other.

8. The mobile device as claimed in claim 1, further comprising:

a dielectric substrate, wherein the main radiation element and the second parasitic element are disposed on the dielectric substrate; and a metal back cover, comprising a bottom plane and a side wall, wherein the side wall and the bottom plane are substantially perpendicular to each other, wherein the side wall has an opening, wherein the dielectric substrate and the first parasitic element are adjacent to the side wall, wherein the antenna structure has a vertical projection on the side wall, and wherein the vertical projection is at least partially inside the opening.

* * * * *